US006956492B2

(12) United States Patent
Beadman et al.

(10) Patent No.: US 6,956,492 B2
(45) Date of Patent: Oct. 18, 2005

(54) DISPLAY SIGNS COMPRISING A FLAT PANEL LOUDSPEAKER

(75) Inventors: Michael Andrew Beadman, Hertfordshire (GB); Michael Anthony Saunders, Kent (GB); David Arthur Vaughn John, London (GB)

(73) Assignee: Talksign Limited, Bromley (GB)

( * ) Notice: Subject to any disclaimer, the term of this patent is extended or adjusted under 35 U.S.C. 154(b) by 25 days.

(21) Appl. No.: 10/416,997

(22) PCT Filed: Nov. 16, 2001

(86) PCT No.: PCT/GB01/05048

§ 371 (c)(1),
(2), (4) Date: Nov. 3, 2003

(87) PCT Pub. No.: WO02/41287

PCT Pub. Date: May 23, 2002

(65) Prior Publication Data

US 2004/0075573 A1 Apr. 22, 2004

(30) Foreign Application Priority Data

Nov. 18, 2000 (GB) ..... 0028187

(51) Int. Cl.[7] ..... G08B 21/00

(52) U.S. Cl. ..... 340/686.1; 340/815.4; 340/691.1; 340/384.1; 446/227

(58) Field of Search ..... 340/686.1, 815.4, 340/815.55, 407.1, 407.2, 384.1, 384.5, 384.73, 679, 691.1, 691.6; 40/409–426; 446/227; 345/173

(56) References Cited

U.S. PATENT DOCUMENTS

| | | | | | |
|---|---|---|---|---|---|
| 4,305,067 | A | * | 12/1981 | Tretiakoff et al. | 340/407.2 |
| 4,326,620 | A | * | 4/1982 | Felix et al. | 194/344 |
| 5,408,417 | A | * | 4/1995 | Wilder | 705/5 |
| 5,801,785 | A | * | 9/1998 | Crump et al. | 348/563 |
| 6,075,925 | A | * | 6/2000 | Downing et al. | 358/1.1 |
| 6,342,831 | B1 | * | 1/2002 | Azima | 340/384.1 |

FOREIGN PATENT DOCUMENTS

| | | |
|---|---|---|
| DE | 2612450 | 10/1977 |
| EP | 0265083 | 4/1988 |
| EP | 0847567 | 6/1998 |
| JP | 02170795 | 7/1990 |
| WO | WO 9709698 | 3/1997 |
| WO | WO 9709848 | 3/1997 |
| WO | WO 9937121 | 7/1999 |
| WO | WO 0002417 | 1/2000 |
| WO | WO 0054548 | 9/2000 |

* cited by examiner

*Primary Examiner*—Jeffery Hofsass
*Assistant Examiner*—Daniel Prévil
(74) *Attorney, Agent, or Firm*—Richard M. Goldberg

(57) ABSTRACT

A display sign is in the form of a flat panel loudspeaker, the graphics of the display being carried on one exposed surface of the flat panel, the latter being provided with one or more transducers such that the flat panel may be energized to transmit sound in accordance with signals supplied to the one or more transducers. The sign may also be provided with an arrangement for storing inputs made by a user for later retrieval.

22 Claims, 8 Drawing Sheets

Fig.3
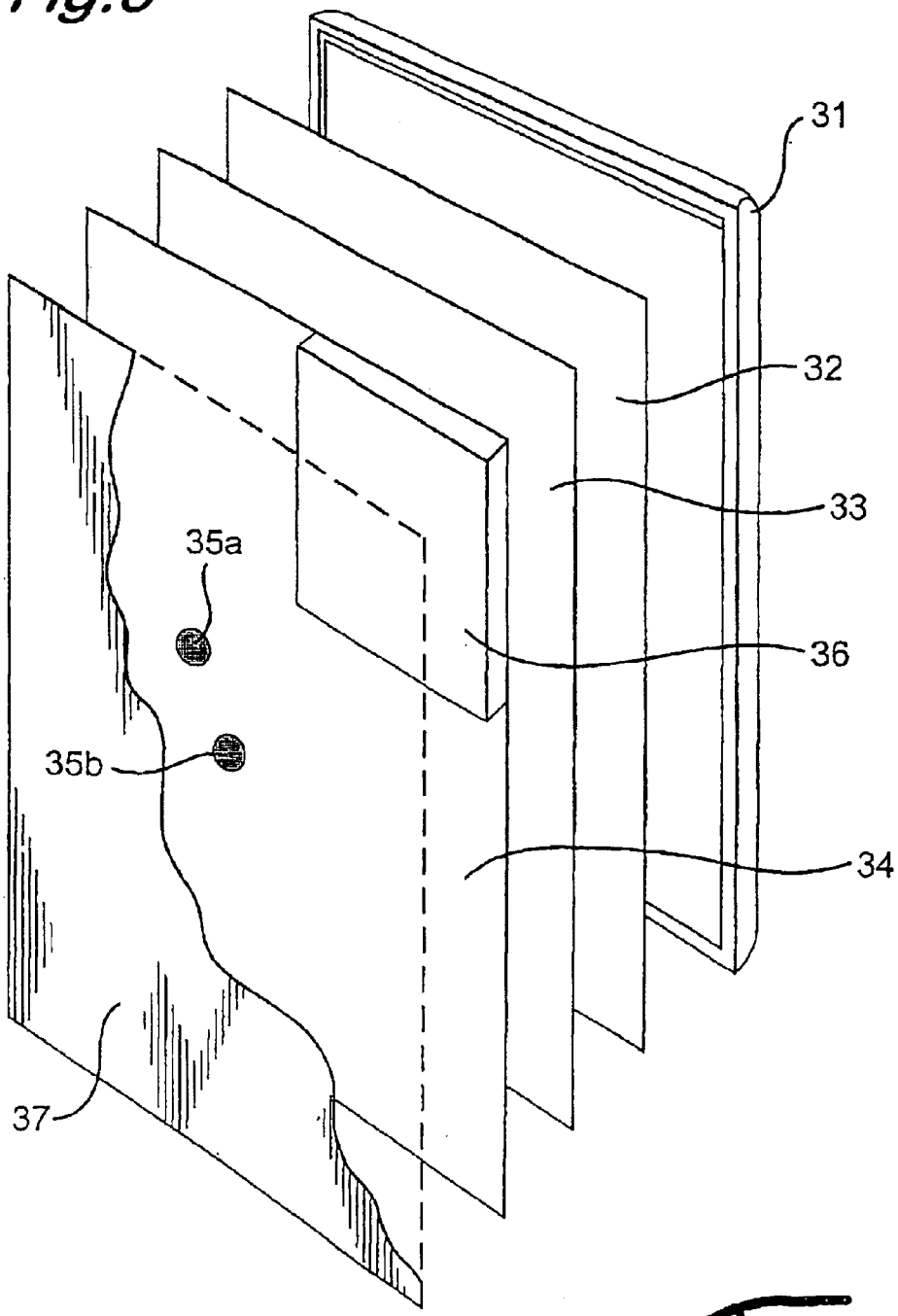
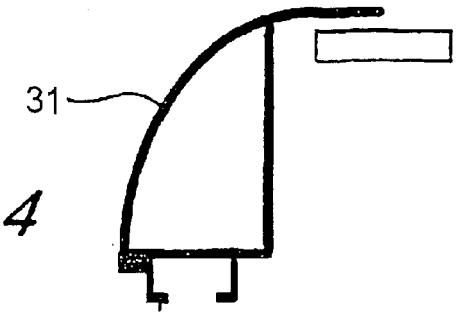
Fig.4

DISPLAY SIGNS COMPRISING A FLAT PANEL LOUDSPEAKER

BACKGROUND OF THE INVENTION

The present invention relates to display signs and in particular to display signs which incorporate means for giving an aural message when, activated by a user and/or have the capability to log information input by a user.

It is known to provide display signs with a loudspeaker through which an aural message can be played from, for example a magnetic tape, through an amplifier when the display sign is interrogated or activated by a user such as by pressing one of a number of buttons.

Although such aural display signs are known they are relatively bulky, expensive to produce and relatively inflexible in their application.

SUMMARY OF THE INVENTION

The present invention is concerned with providing an aural display sign and one which can also log information input by a person using the display sign and which is compact, robust, low cost and constructed in a way which enables it to be easily tailored or adapted to a variety of different operational requirements.

According to a first aspect of the present invention a display sign is in the form of a flat panel loudspeaker, the graphics of the display being carried on one exposed surface of the flat panel, the latter being provided with one or more transducers whereby the flat panel may be energised to transmit sound in accordance with signals supplied to the one or more transducers.

According to a second aspect of the present invention, the one or more transducers are energised by means of a solid state energisation and control system incorporated in the display sign.

According to a third aspect of the present invention, the display sign is provided with a switch arrangement which is incorporated in the display sign to act as an interface between a user and the energisation and control system associated with the one or more transducers.

According to a fourth aspect of the present invention, the switch arrangement comprises one or more capacitative or proximity switches located beneath the graphic display surface whereby a user may operate the switch or switches by placing a finger in the proximity of the switch but on the graphic display side of the panel.

According to a fifth aspect of the present invention the solid state energisation and control system includes a digital audio compression signal processor/decoder through which audio signals from a memory arrangement can be supplied to the one or more transducers in order to energise the latter.

According to a sixth aspect of the present invention a micro-controller is connected between the memory arrangement and the digital audio compression signal processor/decoder in order to reformat the data so that it matches the requirements of the digital audio compression signal processor/decoder.

According to a seventh aspect of the present invention the memory arrangement comprises an SSFDC smart media flash memory which is adapted to store the audio signals in the form of files which have been previously recorded on a computer such as a PC or MAC platform.

According to an eighth aspect of the present invention the memory arrangement also comprises a buffer memory associated with the SSFDC. This buffer memory is preferably a SRAM but could be a DRAM.

According to a ninth aspect of the present invention the energisation and control system includes a remote control receiver (preferably infra-red) whereby the solid state control circuit may be reprogrammed remotely without the need for any physical alteration or adjustment of the display sign and its associated energisation and control system.

According to a tenth aspect of the present invention the display sign incorporates a battery power pack by which the energisation and control system is itself energised.

According to an eleventh aspect of the present invention there is a real time clock within the micro-controller.

According to a twelfth aspect of the invention, there are one or more active switches addressable by the micro-controller to cause the active switch to perform a function such as turning on a light.

According to a thirteenth aspect of the invention, the micro-controller can be placed in a switch programming mode to enable the switches to be programmed on site.

According to a fourteenth aspect of the present invention a display sign is in the form of a flat panel the graphics display being carried on one exposed surface of the flat panel and means being provided to store information which is input to the panel by interaction between the panel and a person external to the panel.

The interaction may be by the person touching the panel at one or more of a plurality of target areas marked in the panel and forming part of the graphics of the display.

BRIEF DESCRIPTION OF THE DRAWINGS

How the invention may be carried out will now be described by way of example only and with reference to the accompanying drawings, in which:

FIG. 3 is an exploded three-quarters view illustrating the physical construction of the display panel of FIG. 1;

FIG. 4 is a cross-sectional view of the frame of the display sign;

DETAILED DESCRIPTION

Figure 1:
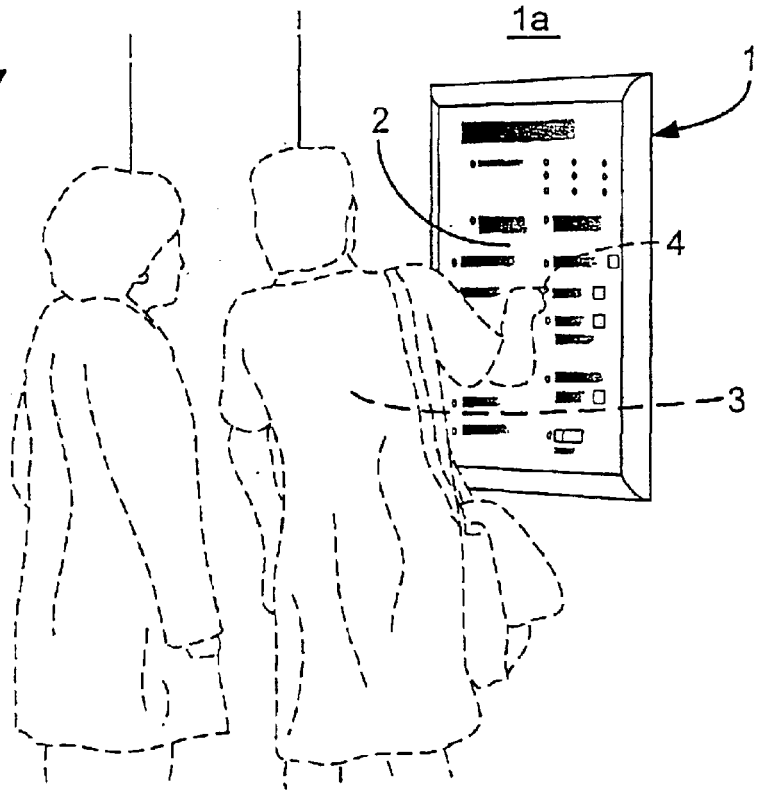
FIG. 1 illustrates how a first embodiment of the present invention may be used.
Figure 2:
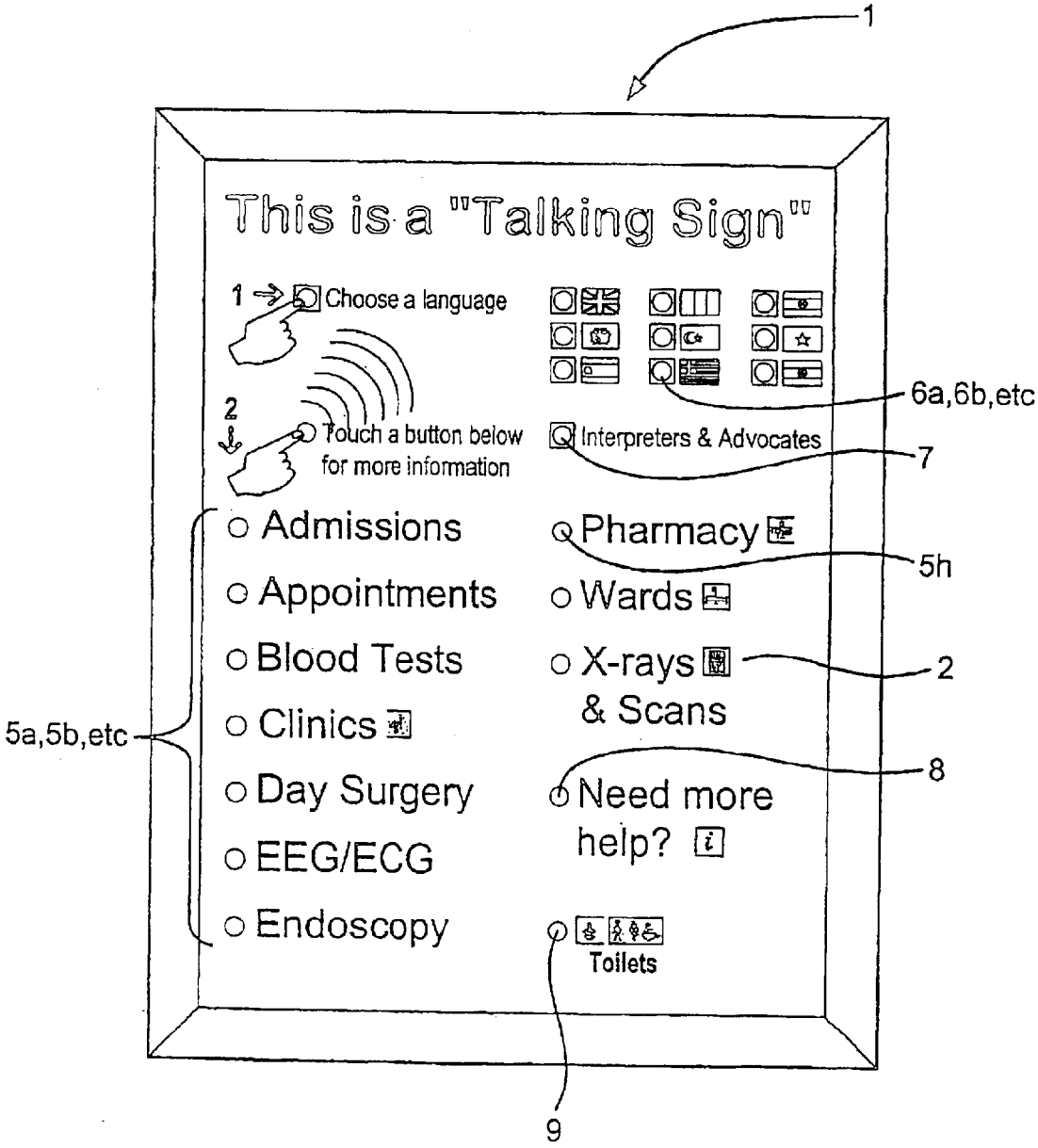
FIG. 2 illustrates in more detail and to a larger scale the graphic display carried by the front exposed surface of the display panel shown in FIG. 1.

FIGS. 1 and 2

A display sign 1 is mounted on a wall, in this case in a hospital.

The purpose of the display sign is to assist a visitor 3 to the hospital in finding and being guided to that part of the hospital which they require.

The display sign 1 has a graphical display 2 which consists essentially of the various locations 5, as shown in detail in FIG. 2, within the hospital such as "Admissions", "Appointments", "Blood Tests" etc and also displays the nine different languages in which the display sign is capable of operating.

The purpose of the display sign 1 is to enable the hospital visitor 3 to ascertain the location of the particular hospital activity or service which that visitor wishes to visit.

In order to do this the visitor 3 first selects the language they require, by touching with their finger 4 a graphical representation of one of the nine buttons 6*a*, 6*b*, 6*c*, 6*d*, 6*e*, 6*f*, 6*g*, 6*h* or 6*i* on the display associated with the national flag of the relevant language, as shown in FIG. 2.

Having done this the display sign will now be set up to give aural information in the selected language.

Having selected the appropriate language the visitor then selects the location which they wish to visit. In this embodiment, there are twelve locations, as illustrated in FIG. 2, comprising "Admissions", "Appointments", "Blood Tests", "Clinics" etc.

Figure 5:
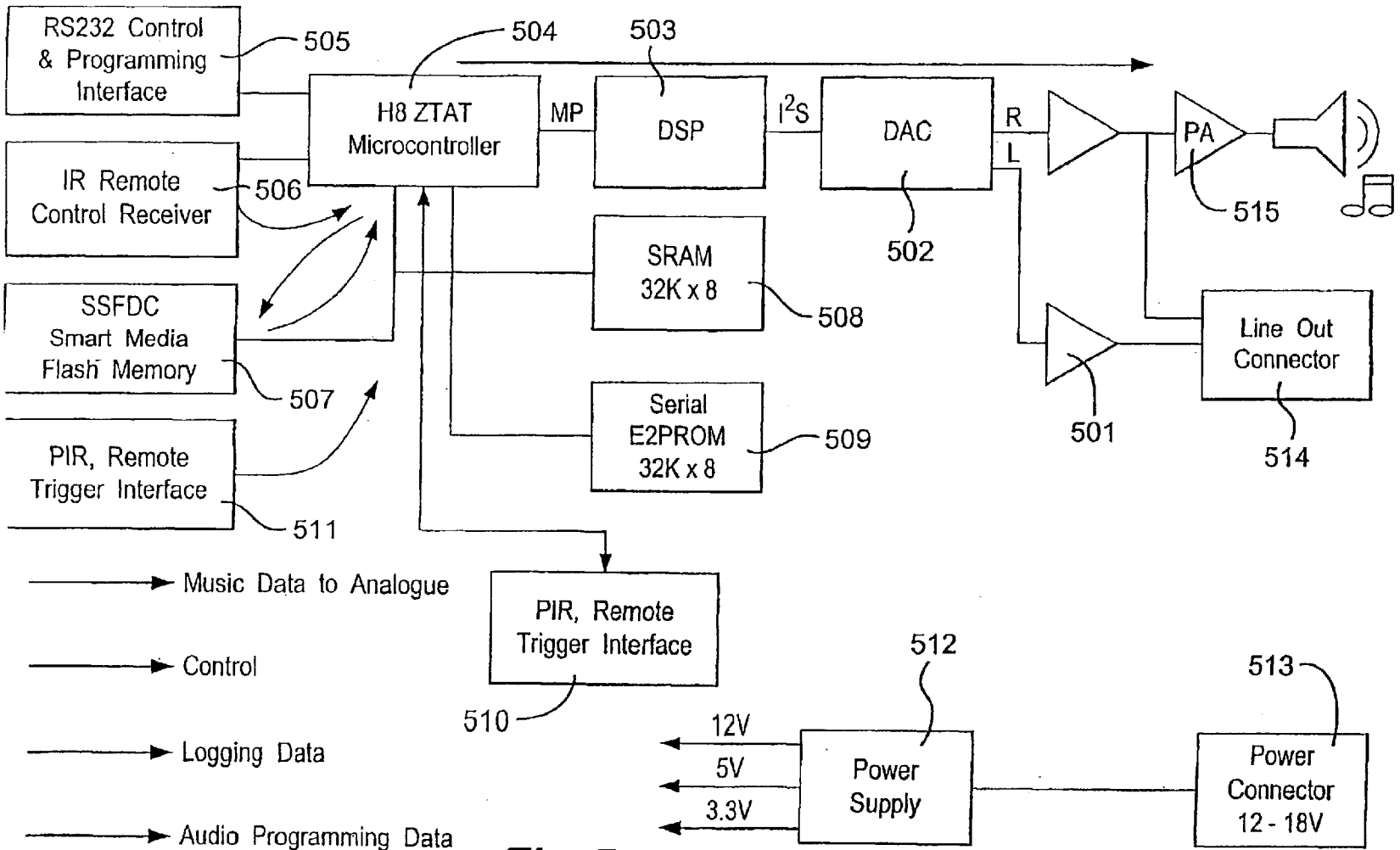
FIG. 5 is a diagrammatic block representation of the energisation and control system of the display panel of FIGS. 1 to 4.

Each of these locations has a virtual "button" 5*a*, 5*b*, 5*c*, etc associated with it. When the visitor touches this virtual "button" the arrangement shown diagrammatically in FIG. 5 is then brought into operation.

For example, if a visitor wishes to visit the Pharmacy Department they will touch the virtual "button" 5*h*. This will then cause the display sign 1 to give aural directions as to how the visitor can find the Pharmacy Department starting from the location of the display sign.

Thus, the display sign as shown in FIGS. 1 and 2 provides a hospital visitor with sound/aural directions as to how to find the various locations within the hospital, instead of, or in addition to, providing a purely visual map of the layout of the hospital from which the visitor must work out their own route.

The display sign is also provided with a virtual "button" 7 by which a visitor can obtain "Interpreters and Advocates".

A virtual "button" 8 is also provided for visitors who require further help and a virtual "button" 9 to provide aural directions to the nearest toilets.

FIGS. 3 and 4

The physical construction of the display sign will now be described with reference to FIGS. 3 and 4.

There is a rectangular frame 31 made from aluminium and having the cross-section shown in FIG. 4.

This frame 31 contains, firstly, a graphics laminate 32 on the front face of which are carried the graphics shown in FIG. 2. This laminate will typically be made of a plastic sheet.

Behind the graphics laminate 32 is a switch assembly 33 which will be described later in relation to FIGS. 5 and 6.

Behind the switch assembly 33 is a loudspeaker panel 34 which comprises a Formica (RTM) sheet which carries one or more (in this case two) exciters or transducers 35. Material other than Formica (RTM) may be used.

Finally, behind the loudspeaker panel 34 is a backing panel 37 which typically is made of cardboard or hardboard.

Figure 6:
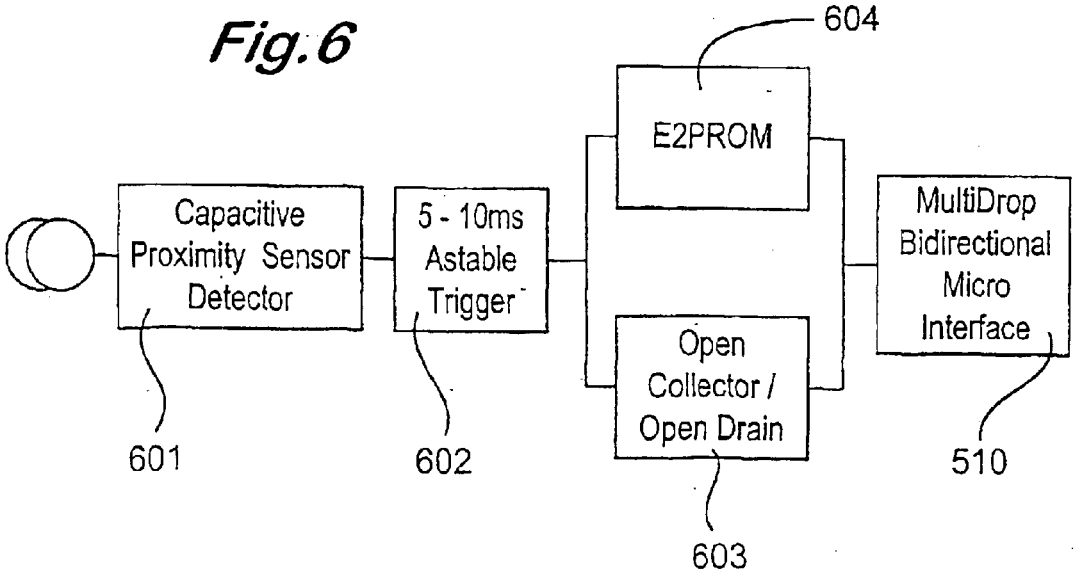
FIG. 6 is a block diagram illustrating the capacitative/proximity switch arrangement of the embodiment of FIGS. 1 to 5.

The energisation and control system for the exciters/transducers 35 is carried by the frame 31 and is generally indicated at 36 in FIG. 3, this arrangement being shown in more detail, but diagrammatically, in FIGS. 5 and 6.

The exciters/transducers 35 are energised by a battery/batteries which form part of the energisation and control system and are mounted within the display sign.

Although the various components making up the display sign are shown in an exploded format in FIG. 3 when they are assembled in their operative positions, the display sign is very compact and in this embodiment, has an overall thickness of just under five centimetres.

The switch arrangement 33 is the mechanism by which the touching by the visitor of the relevant virtual "button" on the graphic display shown in FIG. 3 is translated into a signal or signals which control the exciters/transducers 35 to cause the loudspeaker panel 34 to be energised and thus emit the appropriate aural directions/instructions.

As indicated earlier in this patent specification it is known to provide visual display signs with aural facilities whereby a person "interrogating" the sign will be provided with information in sound form as opposed to visual form. However, such known "speaking signs" utilise conventional loudspeakers which are either completely separate from the sign itself or which are mounted on the sign or carried by the sign, the sound typically emanating through openings or apertures formed in the front face of the sign behind which openings or apertures the conventional loudspeaker is mounted.

Such arrangements are relatively bulky, expensive to manufacture and do not have very good sound quality particularly where the sign is located in a public area where there is typically a relatively high level of ambient random noise.

This embodiment of the present invention utilises so-called flat panel loudspeakers which operate in a different way from conventional loudspeakers employing conventional substantially conical sound radiators.

An example of a flat panel type of loudspeaker is disclosed in international patent application WO 97/09845.

In such a speaker one or more transducers 35*a*, 35*b* in FIG. 3, are physically connected to the speaker panel 34.

The positions of the transducers 35*a*, 35*b* are calculated such that the resulting displacement of the panel 34 sets up random vibrations within the panel 34 due to reflections from the edge of the panel 34 interacting with each other in an apparently random way. At a fixed frequency specific modes of vibration can be seen with nodes and anti-nodes occurring at fixed points on the panel 34 but, due to the wide range of frequencies used in practice, these nodes and anti-nodes constantly move on the surface of the panel 34. Due to the importance of edge reflections in the operation of this type of speaker it is important to ensure that the edge of the panel 34 is free to move as far as possible. To achieve this the panel 34 is mounted around its outer periphery in a compliant foam tape (not shown).

In order to provide the desired level and quality of sound reproduction, via the loudspeaker panel 34, the exciters/transducers 35 need to be placed in the correct positions in relation to that panel.

These positions are chosen so that virtually random motion of the panel 34 is achieved without there being cancellation of some frequencies due to reflections from the edges of the vibrating panel.

FIGS. 5 and 6

The electronic solid state system for energising the exciter/transducer elements 35 will now be described with reference to FIG. 5.

Each of the exciters/transducers indicated at 35 in FIG. 3 and indicated at 501 in FIG. 5, is energised by means of the energisation and control circuit shown in FIG. 5.

The exciters/transducers 501 are energised by a digital-to-analogue converter 502 which is supplied with data from a digital signal processor 503. This DSP is preferably an MPEG Audio Layer 3 (known as an MP3) decoder. Other digital audio compression technologies may be employed such as MPEG Audio Layer 4 (known as AAC).

The MP3 503 provides audio data compression which enables the volume of data necessary in order to provide the variety of aural signals to be provided economically in terms of the amount of memory that the system requires.

The input to the DSP 503 is from a micro-controller 504 the function of which is to reformat the data so that it matches that required by the DSP and enables the system to operate in real-time.

The micro-controller 504 has a number of inputs which comprise a control and programming interface 505, an infrared remote control receiver 506, an SSFDC smart media flash memory 507, a static random access memory (SRAM) 508, a serial E2 programmable read-only memory (E2PROM) 509, a bi-directional multi-drop key interface 510 and a PIR, remote trigger interface 511. The functions of these various inputs to the micro-controller 504 will now be described.

Music data stored in the SSFDC 507 energises the transducers 501 through the micro-controller 504, the DSP 503 and the DAC 502.

The SSFDC 507 could be any suitable solid state non-volatile storage medium which does not require permanent power.

The SRAM 508 is provided to act as a buffer memory if the SSFDC 507 is programmed in situ.

Data from the micro-controller 504 is logged in the serial E2PROM 509.

Data from the micro-controller 504 is also logged at the control and programming interface 505. This data can consist of the tracks played when a track was requested, and error data.

Audio programming data is input to the micro-controller 504 from the control and programming interface 505 and is output from the microcontroller 504 to the SSFDC 507.

Control data can be input to the micro-controller 504 from the control and programming interface 505, from the infrared remote control receiver 506, from the bi-directional multi-drop key interface 510 and from the PIR, remote trigger interface 511.

How the system shown in FIG. 5 operates will now be described.

The micro-controller, 504, detects a key press from the key interface 510 and from this key number determines which audio track number is required. The micro-controller, 504 then uses the P.C. compatible look-up table contained within the Smart Media memory, 507, to find the memory address of the start of the audio track within the Smart media memory 507. The micro-controller then turns these eight-bit wide data bytes into serial data which is transmitted serially to the MP3 decoding DSP, 503.

A separate control bus is also used to configure the DSP from the micro-controller such that the DSP decodes the MP3 data into a standard $I^2S$ serial digital audio stream. The DSP outputs a clock and $I^2S$ data to the Digital to Analogue convertor, DAC, 502, that converts this data into a voltage which is amplified by the stereo amplifiers, 501.

One channel of this analogue signal is finally amplified through a power amplifier, 515, and used to drive the flat panel transducers 35*a*, 35*b*. The second channel can be used with an additional amplifier 501 to drive a second flat panel or conventional speaker through a line out connector 514. Power is supplied to the various components as 3.3 V, 5 V or 12 V by a power supply 512 connected with a 12–18V power connector.

As mentioned earlier the mechanism by which the display sign is rendered sensitive to the hospital visitor's input comprises a number of capacitative/proximity switches which are distributed around the display sign behind the loudspeaker panel itself at locations corresponding to the virtual "buttons" described in connection with FIG. 2.

In other words the locations of the numerous proximity switches are tailored to the particular requirement of the display sign.

This approach contrasts with an alternative which would involve having a very large membrane switch, mounted between the loudspeaker panel and the laminated graphic typically with 800×600 "cells" covering the whole of the display area and not just those parts of it which happen to correspond to the particular virtual "buttons" of the embodiment shown in FIG. 2.

The advantage of such a very large membrane switch is that it would have universal application irrespective of the graphical display employed and the actual location of the virtual "buttons". The disadvantage is that its cost is relatively high.

Therefore, the preferred approach is the one which will now be described in more detail in relation to FIG. 6, namely one employing a relatively few "targeted" proximity switches which are located in the specific locations required in relation to a particular display sign.

More specifically, each of the virtual "buttons" shown in FIG. 2 would have associated with it a single proximity switch.

FIG. 6 illustrates the operation of a single proximity switch for use in the system of FIG. 5 and Incorporation in the display sign shown in FIGS. 2 to 4.

FIG. 6 illustrates diagrammatically an intelligent fault-tolerant proximity switch arrangement.

Those elements of the arrangement shown in FIG. 6 which correspond to elements in the system shown in FIG. 5 are indicated with the same reference numerals.

The proximity switch comprises essentially a capacitative proximity sensor detector 601 which is connected to an astable trigger 602.

The output of the trigger 602 is connected to a circuit comprising an E2PROM 604 and an open collector/open drain 603.

The already described multi-drop bidirectional micro-interface 510 is connected to the E2PROM 604 and the open collector/open drain 603.

The way in which the arrangement shown in FIG. 6 operates will now be described.

When the hospital visitor places their finger on or near the virtual "button" on the display sign this causes the proximity sensor 601 to be activated.

This activation triggers the astable trigger 602 to cause a pulse of between five and ten milliseconds. This pulse enables the E2PROM 604 and triggers the open collector/open drain 603.

In a normal operating condition the system controller 504 (FIG. 5) will receive an interrupt from the key 510 via the multi-drop open collector/open drain 603 collector line going low. In addition the multi-drop line falling also causes all the other proximity switches to be inhibited.

The multi-drop bidirectional micro-interface 510 then sends a read data command to the E2PROM 604, that will be the only device enabled and reads back the proximity switch number in question.

This arrangement enables multiple proximity switches to be used with a wiring system which comprises only three wires plus a power interface and connected to the micro-controller 504. There is virtually no software timing overhead associated with the scanning and debouncing of a large number of switches because the micro-controller is only required to act on a single interrupt when the switch is operated rather than continuously scan a large number of switches.

If a fault develops in the system in FIG. 5, such as where a particular proximity switch is permanently energised due to something adhered to the front of the display panel, after the initial five to ten milliseconds trigger period the astable trigger 602 will not retrigger thus allowing other switches to operate after this initial trigger period. This inhibit function also prevents multiple proximity switches triggering at the same time.

The micro-controller 504 incorporates a real time clock which enables:

i. the time stamping of all switch hits to allow determination of both the time when the sign is mainly in use and to determine if a user is just messing about or if he is listening to the information (by looking at the time between switch presses); this information is logged and can be presented back to the sign sponsor or owner;

ii. the provision of real time announcements eg as a speaking timetable at a bus stop with an estimate of the time to the next bus on a specific route; and iii. the provision of timed announcements to attract users to the sign, e.g. "This is a talking sign please press a button for information".

The system may include one or more active switches where the micro-controller can directly address individual active switches to enable functions within the switch e.g. turn on a light. These active switches are on the same bus as the standard switch and may also be used as ordinary switches although they can be configured as only lights from the micro-controller. These lights can be used to highlight areas of the sign.

The switch system described with reference to the drawings has a further advantage. Because the ordinary switches are all identical the main micro-controller can be placed in a switch programming mode (using the control and programming interface, 505) and then the ordinary switches can be programmed in situ. This makes the manufacture of individually tailored or customised signs very efficient as all the parts are standard and are only configured once they are in the sign.

Instead of utilising digital audio compression e.g. the above described MP3 arrangement, the invention may utilise sampled audio.

The first embodiment just described with reference to FIGS. 1 to 6 places the emphasis on the display sign generating an aural output in response to a user interacting with the sign typically by "touching" a virtual button. However, as indicated earlier the display sign of the present invention may also log information produced as a result of the users' interaction with the display sign.

In contrast the second embodiment of the present invention which will now be described with references to FIGS. 7 to 10 places the emphasis on the information logging capability of the display sign rather than on its aural capability.

This second embodiment is suitable for, in effect, conducting surveys of users of a facility, such as a restaurant or chain of restaurants. It therefore has greatly increased data logging capacity and greatly reduced aural/audio capacity when compared with the embodiment of FIGS. 1 to 6.

Figure 7:
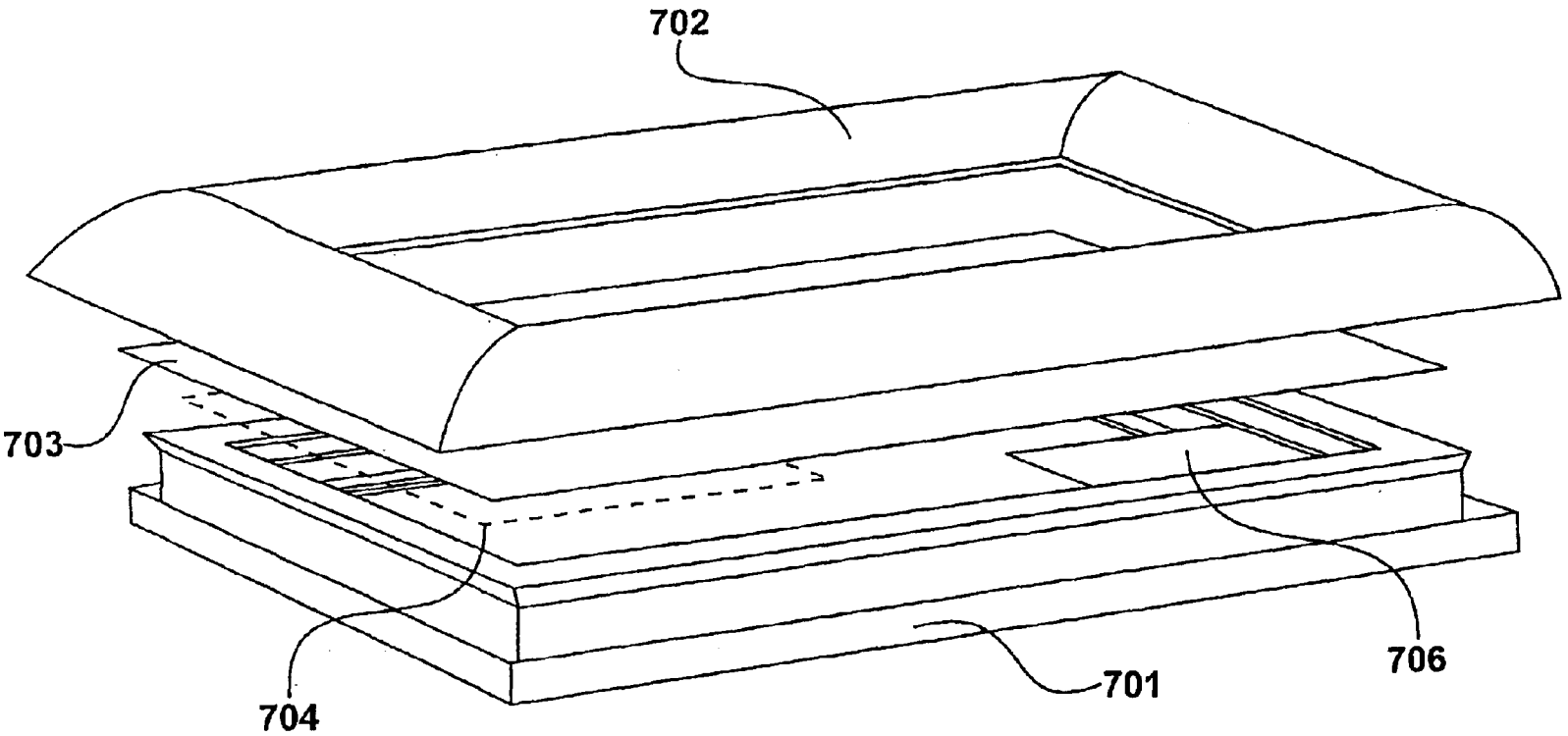
FIG. 7 is an exploded perspective view of the main components of a second embodiment of the invention.
Figure 8:
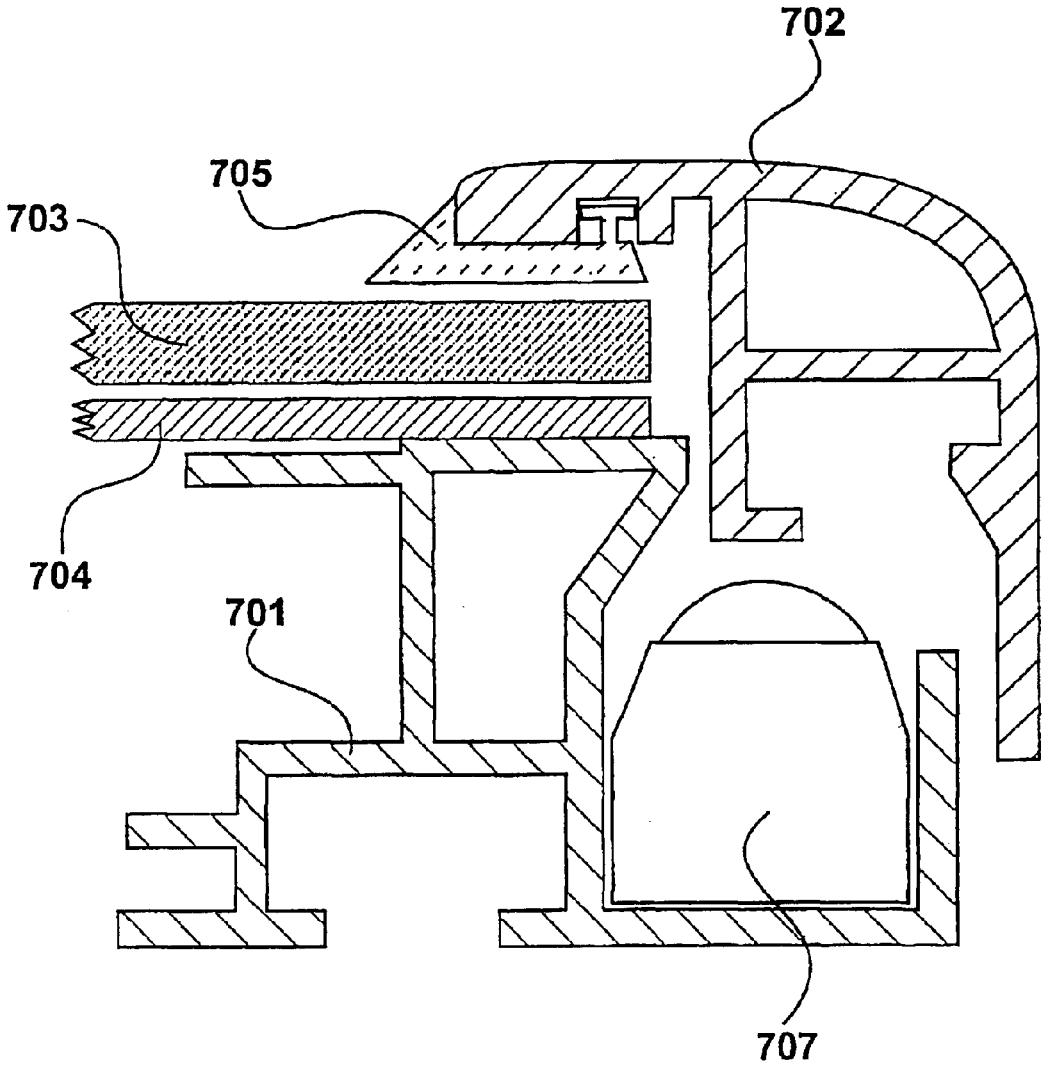
FIG. 8 is an enlarged fragmentary sectional view of FIG. 7.

FIGS. 7 and 8

The display sign's mechanical structure comprises in essence a box like base or rear unit 701, and front frame member 702, which is a snap fit onto the base unit 701, a transparent window 703 and a graphics laminate 704. The window 703 and graphics laminate 704 are sandwiched between the base unit 701 and the front frame 702. In addition to the snap-fit other additional means may be used to securely lock the units 701 and 702 together.

A flexible seal 705 is carried by the frame 702 and the whole of the latter's inner periphery. The seal 705 makes a waterproof contact with the periphery of the window 703.

The electronic control system is indicated at 706 and the battery power supply at 707.

In this embodiment the base unit 701 is manufactured from aluminium extrusions having the cross-sections shown In FIG. 8. The front frame 702 is also manufactured from an aluminium extrusion. The window 703 is manufactured from a transparent polycarbonate or acrylic material.

As indicated earlier the frame 702 is a snap-fit onto the base unit 701, the latter being secured to a wall by appropriate means such as screws (not shown). Access can then be easily gained to the graphical display, electronic control system and the batteries by simply detaching the frame 702, and window 703, from the base unit 701, the latter remaining secured to the wall or other mounting.

Although not shown in FIGS. 7 and 8, the display sign also incorporates the equivalent of the exciters or transducers 35 of FIG. 3 in order to make the assembly operate as a loudspeaker in the manner already described.

Figure 9:
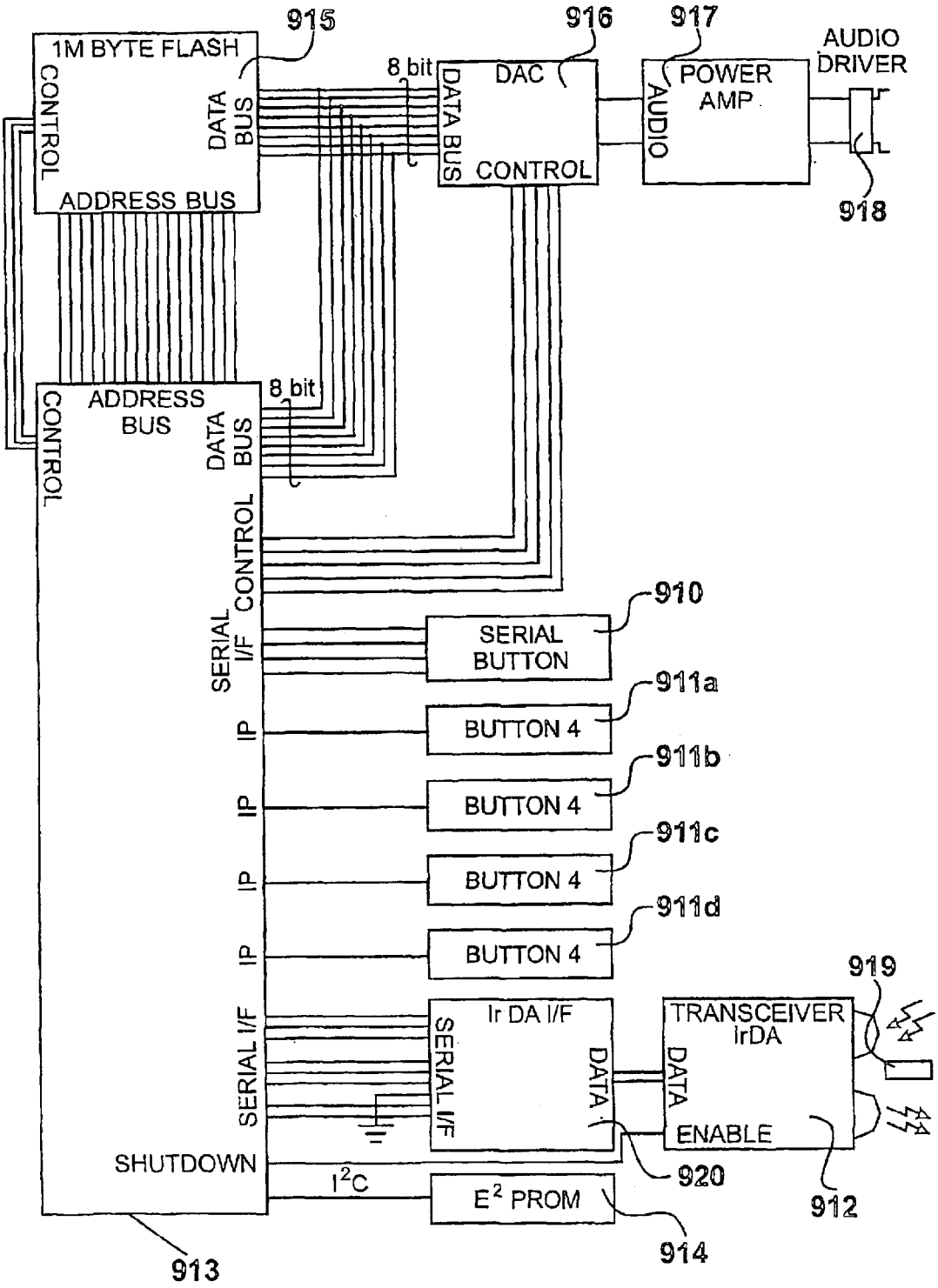
FIG. 9 is a block diagram of the electronic system incorporated in the embodiment of FIGS. 7 and 8.
Figure 10:
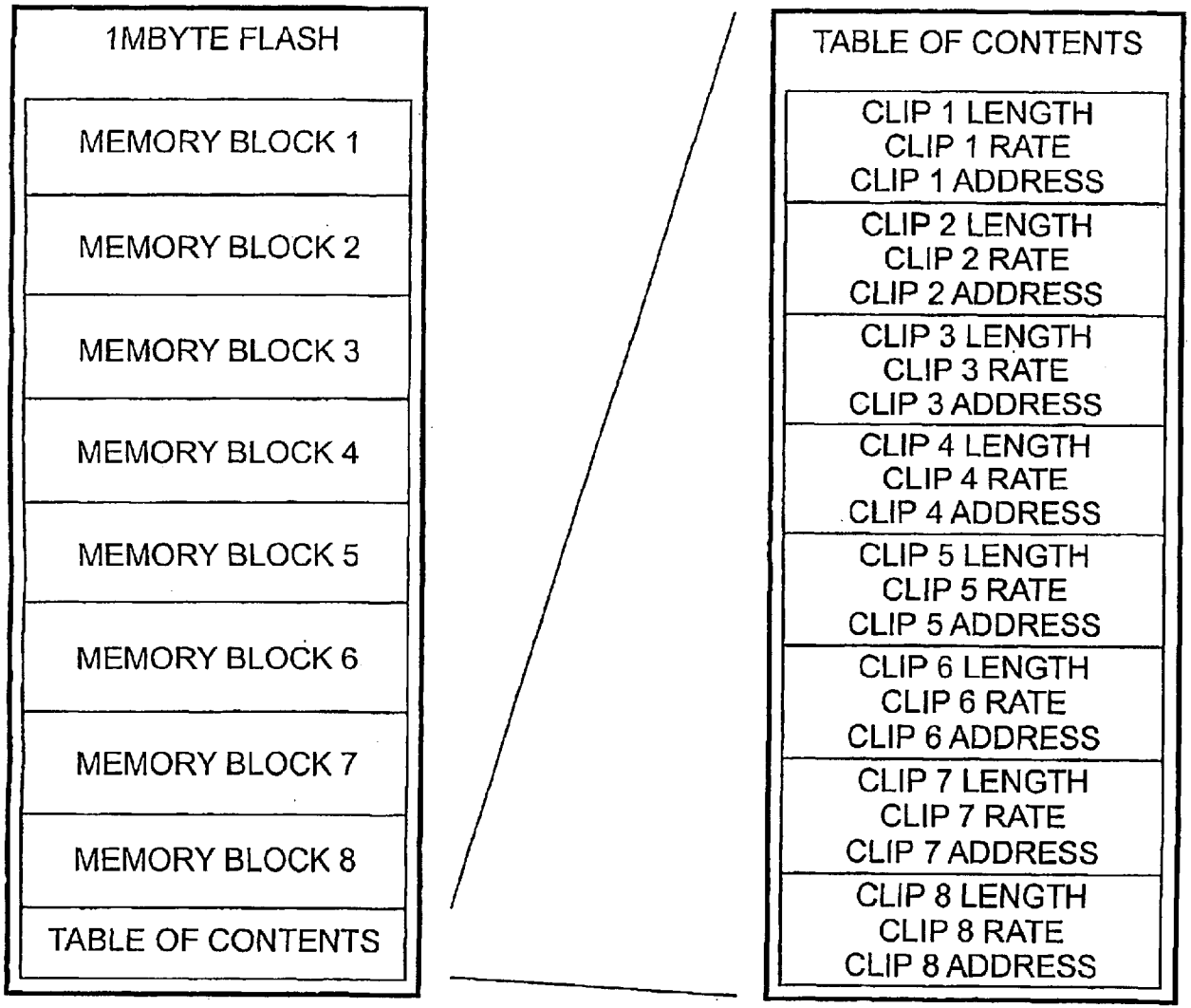
FIG. 10 is a block diagram illustrating the flash memory arrangement of the embodiment of FIGS. 1 to 5.

FIGS. 9 and 10

These illustrate the essential elements of the electronic control system shown at 706 in FIG. 7.

There are three ways in which inputs can be made to the sign's electronic system, these being shown at 910, 911*a, b, c* and *d* and 912 respectively.

The inputs are fed into a microprocessor 913 which controls a) an output to an $E^2$ PROM 914 (erasable programmable read-only memory); b) an output to a flash memory 915; c) and an output to a digital-to-analogue converter (DAC) 916.

The output from the DAC 915 is fed to a power amplifier 917 and thence to an audio driver/exciter/transducer 918 which is the equivalent of 35 in FIG. 3.

Input 910 is a so-called serial button that is capable of inputting a variety of commands to the microprocessor 913 depending, for example, on the number of times it is pressed.

Inputs 911*a* to 911*d* are hard-wired buttons each of which is then only capable of making a single type of predetermined input to the microprocessor 913.

The third type of input 912 comprises an Infra-Red Data Association (IRDA) transceiver operable by means of a hand-held remote controller 919. However, the IRDA's main purpose in many applications is to enable the logged information to be downloaded from the display sign.

The IRDA transceiver 912 is connected to a serial I/F unit 920 which in turn is connected to the microprocessor 913.

On receipt of an input either from the hardwired switch inputs 911 or the serial switch inputs 910 or the IRDA link 912 the microcontroller 913 powers up the amplifier 917 and peripherals, logs the key hit in the E 2PROM 914 and, depending on the content of the flash memory 915 Table of Contents, plays audio by consecutively addressing the flash memory 915 and latching the resulting data into the digital-to-analogue converter 916, which converts the 8-bit level information into an analogue output to feed into the power amplifier 917 and from this to the audio driver 918 as an analogue audio signal.

The system of FIG. 9 may be simplified by omitting the flash memory 915 and then the audio is played directly out of the microcontroller memory 913. This simpler system is suitable for a short beep or other simple sampled audio message.

The microcontroller 913 includes a real time clock such that all logging can be linked to real time.

The IRDA 912 is to be used to download logging information to a remote handheld computer such as a laptop or Palm Pilot type system 919. It will also be used to upload new audio data to either the flash memory 915 or to the microcontroller 913 together with control and real time setup information as necessary.

The internal logging data is stored in $I^2C$ interfaced $E^2PROM$ 914. This technique allows use of variable sizes of $E^2PROM$ depending on the application requirement.

This arrangement is more efficient than a logging system which logs the time and date of each switch push together with the switch number. This is very wasteful of which with each entry consisting of several bytes of data.

The system of the present invention is a flexible system utilising all the $E^2PROM$ memory, configurable to suit the application. The memory is divided up into sections by time; with each time slot consisting of 2-bytes for each switch i.e. three switches require 6 bytes. With a 2-byte slot up to 65536 single switch presses can be recorded in one time slot. When the switch is operated the microcontroller 913 uses its real time clock to determine which slot to use and increments the correct switch counter in the correct time slot.

For a high throughput application where accurate understanding of the timing of the presses is required the system can be configured with very small time slots e.g. five minutes. In the other extreme where an understanding of slow trends is required the system may have a two hour time slot with data collected over days or weeks.

For example a system with a 4K $E^2PROM$ configuration to a one hour timeslot could log information on three buttons for twenty-eight days. At the end of the twenty-eight days the system allows several options in the setup.

The data can be overwritten with new switch presses.

The data can be cumulative i.e. the time "rolls over" and new switch presses are incremented in addition to those of twenty-eight days before.

The logging can stop.

To avoid losing the setup during power down the system setup is stored in the $E^2PROM$ with the log and to avoid confusion when downloading the setup data is included in the download.

In the system setup the following data is included:

Serial Number—unique sign serial number is programmed at manufacture to ensure multiple signs using the same download software are never confused.

Time Granularity—time slot size.

Maximum number of Time Slots—included such that the rollover point can be predicted Key Factor—Minimum time between logged keys.

flags—Data Overwrite, Data Accumulate, Stop on Max Time Slots . . . .

It is possible to add further $E^2PROM$ devices to extend the logging time.

FIG. 10

The flash memory 915 contains the audio data. The format of the data is such that consecutive addresses read out of the memory at the correct sample rate will make up the original audio signal.

In this embodiment an IMB device consisting of eight blocks of 128 KB is used. It has been determined that the maximum number of different audio clips is eight although the format allows almost the entire memory to be configured as one clip. A Table of Contents, is included at the end of block eight, defining the Start point of each clip, the sample rate of each clip and the length in bytes of each clip. This allows the microcontroller 913 to determine the parameters of each audio clip to be played when a switch is activated and maintains a flexible format that can be expanded if more memory and audio is required.

With an IMB device the maximum amount of audio using 8 KHz sample rate is sixteen seconds and using a 4 KHz sample rate the maximum is thirty-two seconds.

Manner of Use

The embodiment of FIGS. 8 to 10 is designed to canvas users of a facility, such as a restaurant, as to their views on various matters related to that facility. This is achieved by the customer making inputs to the display sign through the inputs 910 and 911.

The user is presented with a simple statement and large graphic showing a number of switch areas. The user can select one of these switch areas by pushing the area itself. If more than one is selected then the first will be logged and any further pushes will operate the audio but are not logged until there is a predetermined time gap.

The logged information from the customers can be downloaded, for example by the manager of the facility by means of the hand held device 919.

The unit 912 will be accessed through the window 703 using the handheld device 919 such as a Palm Pilot or PC based laptop.

On command from the handheld device 919 the IRDA interface will start communications and wait for the IRDA timeout (10s default) for a command from the handheld device 919.

Each sign will have unique identity (programmed at manufacture) and this will be transmitted to the handheld device 919 on start up of communications. This identity can have a "real name" associated with it on the setup screen. This will allow one handheld device 919 to be used with many display signs and the data from each display sign stored uniquely thus avoiding the manager accidentally overwriting the logging data.

The manager may also use the hand held device 919 to input new data into the system of FIG. 9.

In this embodiment the valid commands are:

| | | |
|---|---|---|
| L | Download Log Data | Log Data comma delimited between keys, New line delimited by granularity. Final byte is system status byte consisting batter life indication. |
| E | Erase | Erase log data. |
| S | Upload Setup Data | Log Granularity, Key Factor, IRDA Timeout, Current Time. |
| A | Upload Audio Data | Custom Format Sampled Audio. |
| P | Play Audio Data | Must be followed by key number (1, 2, 3) |

The E, erase, command is a separate function to the L,Log, command to allow the data log to accumulate or be restarted as required, allowing the manager to check the data without erasing in between official collection periods.

The IRDA Port software will consist of two screens.

| | |
|---|---|
| Command Screen | Issuing commands as shown above with a window for feedback information and confirmation of operation being completed. This screen will also show a list of sign setups with a "real name" of each sign such that the sign being communicated with can be verified. |
| Setup screen | Granularity, key factor, timeouts etc for each sign in the system can be set. |

The power supply is designed to maximise the battery life. The main system runs at 3.3V, with the amplifier running directly from the battery 707 which is compensated to prevent audio volume change over the battery's life.

During operation the system wakes up on receipt of a key hit, logs the hit according to the microcontroller simulated real time clock, plays the required track and returns to sleep. The main battery use is powering the amplifier during playback, with the real time click and key circuitry using negligible power continuously.

Compared with the first embodiment of FIGS. 1 to 6 the second embodiment of FIGS. 7 to 10 has reduced audio capability which is limited essentially to acknowledging to the user/customer the fact that the user/customer has entered data.

What is claimed is:

1. A display sign comprising;

a flat panel loudspeaker including at least one transducer such that the flat panel loudspeaker is energizable to transmit sound in accordance with signals supplied to the at least one transducer, a panel including graphics carried on one exposed surface thereof, in which said graphics include graphical input indications as to where to touch the panel;

a number of proximity switches located behind said graphical input indications such that each switch is operable by a user placing a finger in proximity of the switch; and a solid state energization and control system which energizes the at least one transducer, said solid state energization and control system including:

a memory arrangement, a digital signal processor/controller through which compressed audio signals from said memory arrangement are arranged to be supplied to the at least one transducer in order to energize the latter, and a remote control receiver whereby the solid state energization and control system is adapted to be reprogrammed remotely without the need for any physical alteration or adjustment of the display sign.

2. A display sign as claimed in claim 1, in which the solid state energization and control system includes an MP3 digital signal processor/decoder through which audio signals from a memory arrangement are supplied to the at least one transducer in order to energize the latter.

3. A display sign as claimed in claim 2, further comprising a micro-controller connected between the memory arrangement and the MP3 digital signal processor/decoder in order to reformat data so that the data matches requirements of the MP3 digital signal processor/decoder.

4. A display sign as claimed in claim 3, in which there is at least one active switch addressable by the micro-controller to cause the active switch to perform a function.

5. A display sign as claimed in claim 4, in which the micro-controller is adapted to be placed in a switch programming mode to enable the switches to be programmed in situ.

6. A display sign as claimed in claim 2, in which the memory arrangement comprises an SSFDC smart media flash memory which is adapted to store the audio signals in the form of files which have been previously recorded on a computer.

7. A display sign as claimed in claim 6, in which the memory arrangement also comprises a buffer memory associated with the SSFDC smart media flash memory.

8. A display sign as claimed in claim 1, further comprising a battery power pack which energizes the energization and control system.

9. A display sign comprising:

a flat panel loudspeaker including at least one transducer such that the flat panel loudspeaker is energizable to transmit sound in accordance with signals supplied to the at least one transducer;

a flat panel having an exposed surface which carries a graphics display including graphical input indications as to where to touch the panel;

a number of proximity switches located behind said graphical indications such that each switch is operable by a user placing a finger in proximity of the switch;

a storage device which stores information which is input to the panel by interaction between the panel and a person external to the panel; and a control circuit comprising a microprocessor/microcontroller configured to receive input signals from said switches and in response to receiving said input signals to (i) supply first output signals to said at least one transducer to transmit sound, and (ii) supply second output signals to said storage device such that details of user operations are logged.

10. A display sign as claimed in claim 9, in which the said storage device comprises a control circuit having at least one first input switch operable by the person and a second input switch operable by an infra-red signal generated externally of said display sign by a remote control device.

11. A display sign as claimed in claim 9, further comprising a flash memory for storing audio data for outputting to said at least one transducer mounted on the display sign.

12. A display sign as claimed in claim 11, further comprising a digital-to-analog converter, and data from said microprocessor/microcontroller is input to the digital-to-analog converter and an output of said digital-to-analog converter is input to said transducer through a power amplifier.

13. A display sign as claimed in claim 9, further comprising a remote control device adapted to download data stored in said storage device.

14. A display sign as claimed in claim 9, in which said storage device comprises an erasable programmable read-only memory (EPROM).

15. A display sign as claimed in claim 9, in which the control circuit includes an infra-red data association transceiver.

16. A display sign as claimed in claim 9, in which the microcontroller/microprocessor incorporates a real time clock so that said details of user operation logged in said storage device are linked to real time.

17. A display sign as claimed in claim 16, in which the memory of the storage device is divided up into sections by time slots, with each time slot: including a plurality of bytes for each of said switches, such that when a switch is operated the microprocessor/microcontroller refers to said real time clock to determine which slot to use and increments a counter in said time slot.

18. A display sign as claimed in claim 9, further comprising a box-like base member having detachably connected thereto a frame member, a window laminar sheet and a graphics laminar sheet comprising said flat panel being sandwiched between said frame member and said box-like member.

19. A display sign as claimed in claim 18, in which said box-like base member and said frame member are fabricated from extruded metal sections.

20. A display as claimed in claim 18, which the window laminar sheet comprises & transparent plastic material.

21. A display sign as claimed in claim 9, further comprising a remote control transmitter/receiver configured to transmit logged data stored in said storage devices.

22. A display sign as claimed in claim 21, further comprising flash memory and said remote control transmitter/receiver is also configured to receive new audio data for storage in said flash memory.

* * * * *